US007841832B2

(12) United States Patent
Kitamura

(10) Patent No.: US 7,841,832 B2
(45) Date of Patent: Nov. 30, 2010

(54) FAN FOR GENERATING AN AIR FLOW

(75) Inventor: Junpei Kitamura, Kyoto (JP)

(73) Assignee: Nidec Corporation, Kyoto (JP)

( * ) Notice: Subject to any disclaimer, the term of this patent is extended or adjusted under 35 U.S.C. 154(b) by 725 days.

(21) Appl. No.: 11/860,091

(22) Filed: Sep. 24, 2007

(65) Prior Publication Data

US 2008/0075596 A1 Mar. 27, 2008

(30) Foreign Application Priority Data

Sep. 26, 2006 (JP) ..... 2006-261363

(51) Int. Cl.
*F01D 5/02* (2006.01)

(52) U.S. Cl. ..... 416/144; 416/190

(58) Field of Classification Search ..... 416/144, 416/190

See application file for complete search history.

(56) References Cited

U.S. PATENT DOCUMENTS 6,302,650 B1 * 10/2001 Williams et al. ..... 416/144
7,063,507 B2 * 6/2006 Hsieh ..... 416/144
7,281,896 B2 * 10/2007 Yu et al. ..... 416/144
7,717,679 B2 * 5/2010 He ..... 416/144

FOREIGN PATENT DOCUMENTS

| | | | |
|---|---|---|---|
| JP | 6398498 | U | 6/1988 |
| JP | 1152136 | U | 10/1989 |
| JP | 6284666 | A | 10/1994 |
| JP | 713095 | A | 1/1995 |
| JP | 2000184678 | A | 6/2000 |
| JP | 2000352397 | A | 12/2000 |
| JP | 2004159421 | A | 6/2004 |

* cited by examiner

*Primary Examiner*—Igor Kershteyn
(74) *Attorney, Agent, or Firm*—Keating & Bennett, LLP

(57) ABSTRACT

A weight adjustment portion is formed at an upper end of a hub to project radially inward. An approximately U-shaped balance clip is attached to the weight adjustment portion. A gap to be constantly ensured is formed axially between the weight adjustment portion and a rotor holder. For ensuring the gap, a plurality of seats are provided on the lower surface of the weight adjustment portion at regular circumferential intervals. The rotor holder is press-fitted to the hub until the rotor holder comes into contact with the seats. The upper surface of the weight adjustment portion is positioned lower than the uppermost portion of the hub, thereby preventing the balance clip projecting from the uppermost portion of the hub when the balance clip is attached to the weight adjustment portion.

14 Claims, 10 Drawing Sheets

FAN FOR GENERATING AN AIR FLOW

BACKGROUND OF THE INVENTION

1. Field of the Invention

The present invention relates to the correction of unbalance of rotation of a rotor of a fan.

2. Description of the Related Art

Currently, electronic devices are equipped with cooling fans for dissipating heat generated inside the electronic devices. The recent enhancement in performance of electronic devices has lead to an ever-increasing amount of internal heat generation, which inevitably calls for improvement of cooling characteristics of the fans. In order to improve cooling characteristics of the fans, air volume and static pressure of the fans need to be increased. For increasing the air volume and static pressure, the fans need to be run at higher speeds. Meanwhile, many electronic devices are used in homes and offices nowadays; for this reason, quiet operation of electronic devices is also demanded.

Noise during operation is caused mainly by an airflow generated by rotation of blades of the fan and making blade passing tones, and vibration associated with the rotation of the fan. As for the blade passing tones, the noise level can be reduced by optimization of the shape of the blades. There is, however, a limit to the reduction of this kind of noise, since the blade passing tones are naturally produced wherever an airflow is generated. On the other hand, the vibration can be reduced to a least possible degree by physically eliminating unbalance of rotation of a rotor.

The vibration value increases as the rotational speed of the fan increases. Since an impeller of the fan is a rotor, physically unbalanced rotation may be caused with respect to the rotation axis. In other words, eccentricity of center of gravity occurs with respect to the rotation axis. While zero is ideal for a value indicating the degree of unbalanced rotation (hereinafter, referred to an unbalanced amount), it is almost physically impossible. Therefore, there arises a need to provide correction of unbalance of rotation so as to bring the unbalance amount of the impeller with respect to the rotation axis, which is produced when the impeller is rotating, as close to zero as possible.

The vibration of the fan not only resonates with the housing of the electronic device and generates noises, but also may adversely affect other electronic components. This is a reason why the vibration of the fan needs to be reduced. And beside, the housing of the recent electronic device have become small in size, hence the installation space for the fan is restricted in the housing. It is required that a space be provided in the air intake area of the fan so as not to hinder entering of air, in order to maximize cooling performance of the fan.

SUMMARY OF THE INVENTION

A fan according to an embodiment of the present invention includes an impeller having a circular projected portion projecting radially inward from an upper end portion of a hub so as to cover the vicinity of the outer periphery of a lid of a rotor holder. A gap is formed between the circular projected portion and the rotor holder in the axial direction. In this configuration, a balance weight can be fixed to the circular projected portion, whereby the unbalance of rotation can easily be corrected.

Other features, elements, advantages and characteristics of the present invention will become more apparent from the following detailed description of preferred embodiments thereof with reference to the attached drawings.

DETAILED DESCRIPTION OF PREFERRED EMBODIMENTS

Figure 1:
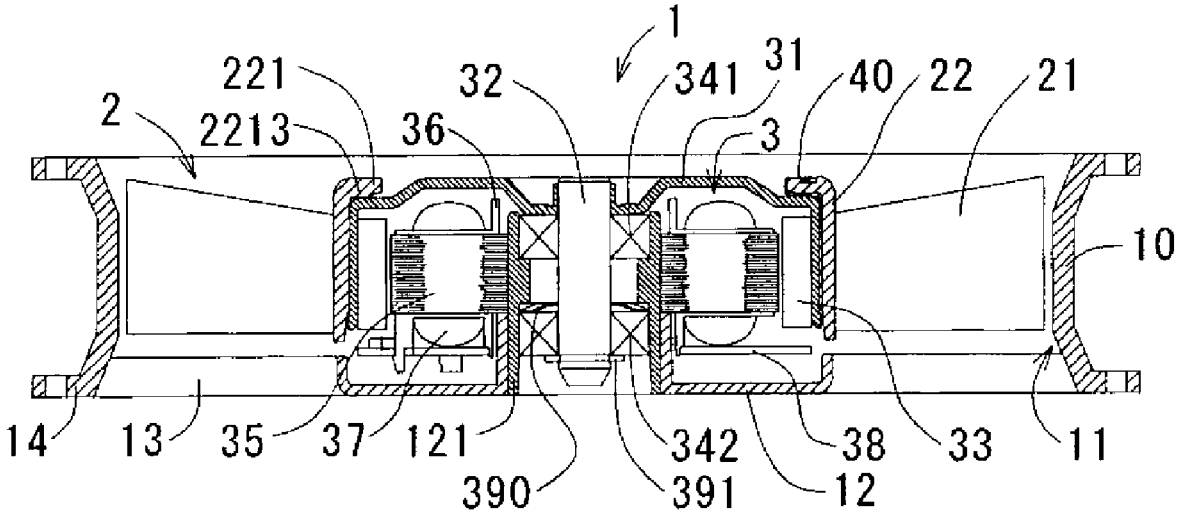
FIG. 1 is a cross-sectional view of a fan according to a preferred embodiment of the present invention.

Referring to FIGS. 1 through 10, preferred embodiments of the present invention will be described in detail. It should be noted that in the explanation of the present invention, when positional relationships among and orientations of the different components are described as being up/down or left/right, ultimately positional relationships and orientations that are in the drawings are indicated; positional relationships among and orientations of the components once having been assembled into an actual device are not indicated. Meanwhile, in the following description, an axial direction indicates a direction parallel to a rotation axis, and a radial direction indicates a direction perpendicular to the rotation axis.

Figure 2:
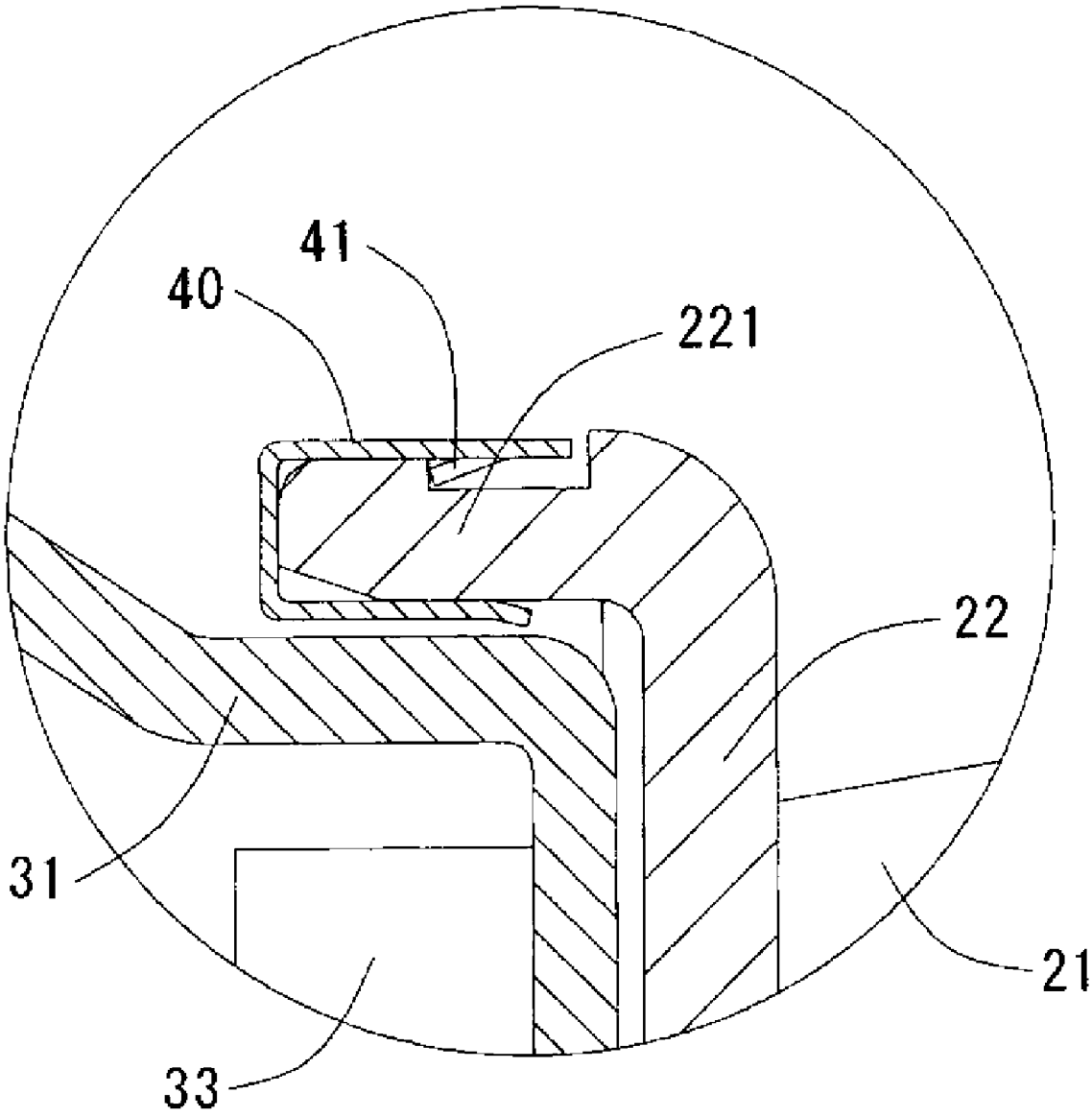
FIG. 2 shows a weight adjustment portion and a balance clip attached thereto according to the preferred embodiment of the present invention.
Figure 3:
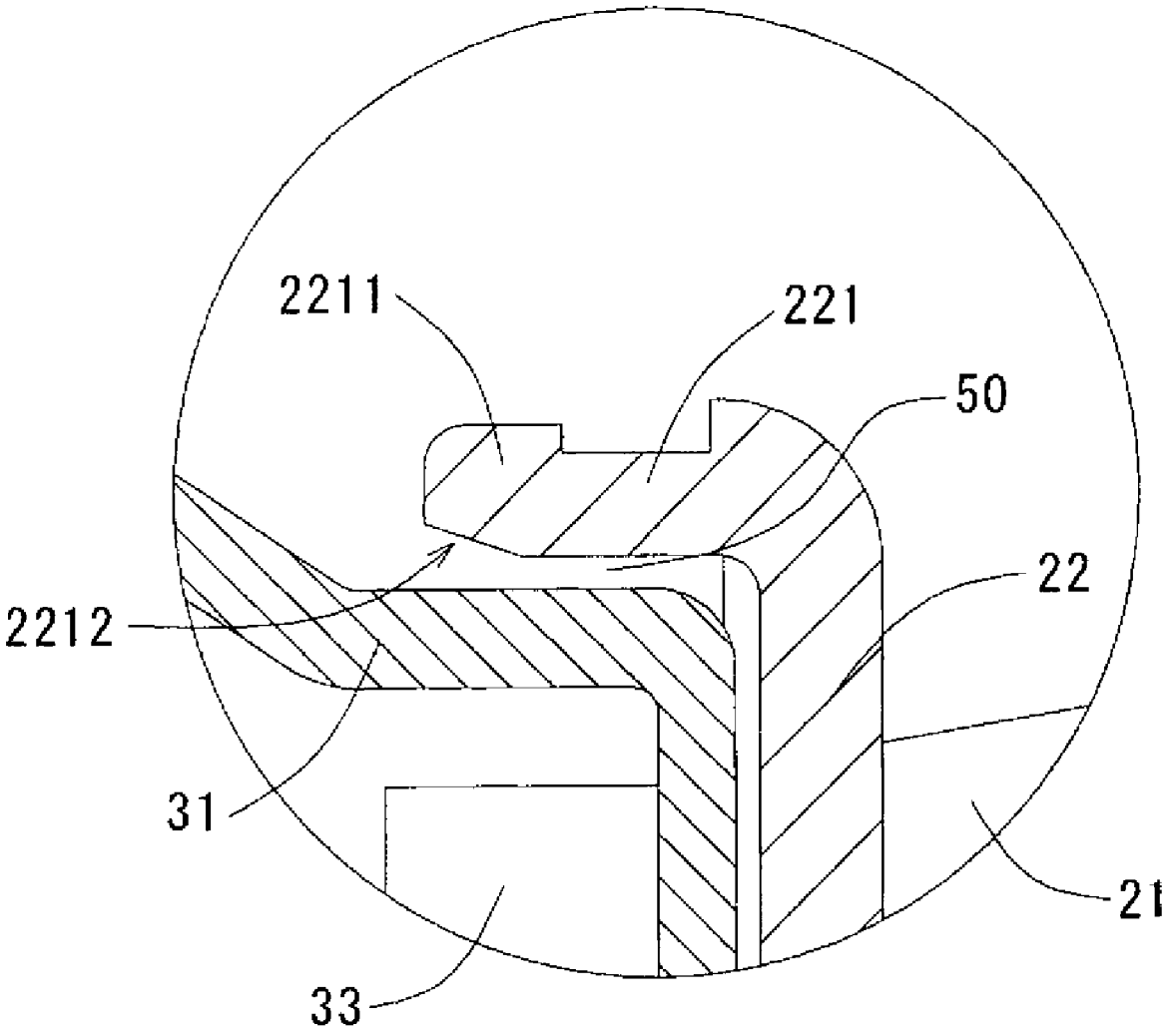
FIG. 3 shows the weight adjustment portion according to the preferred embodiment of the present invention.
Figure 4:
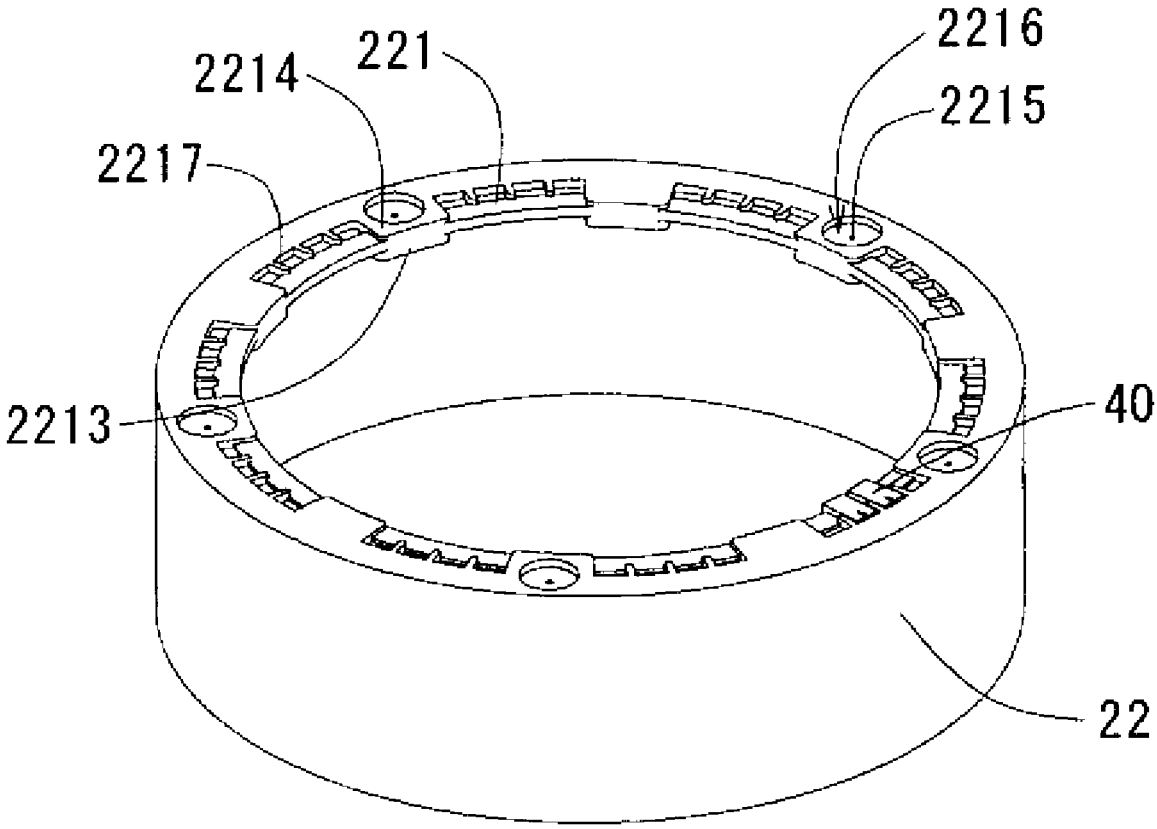
FIG. 4 is a perspective view of a hub according to the preferred embodiment of the present invention.
Figure 5:
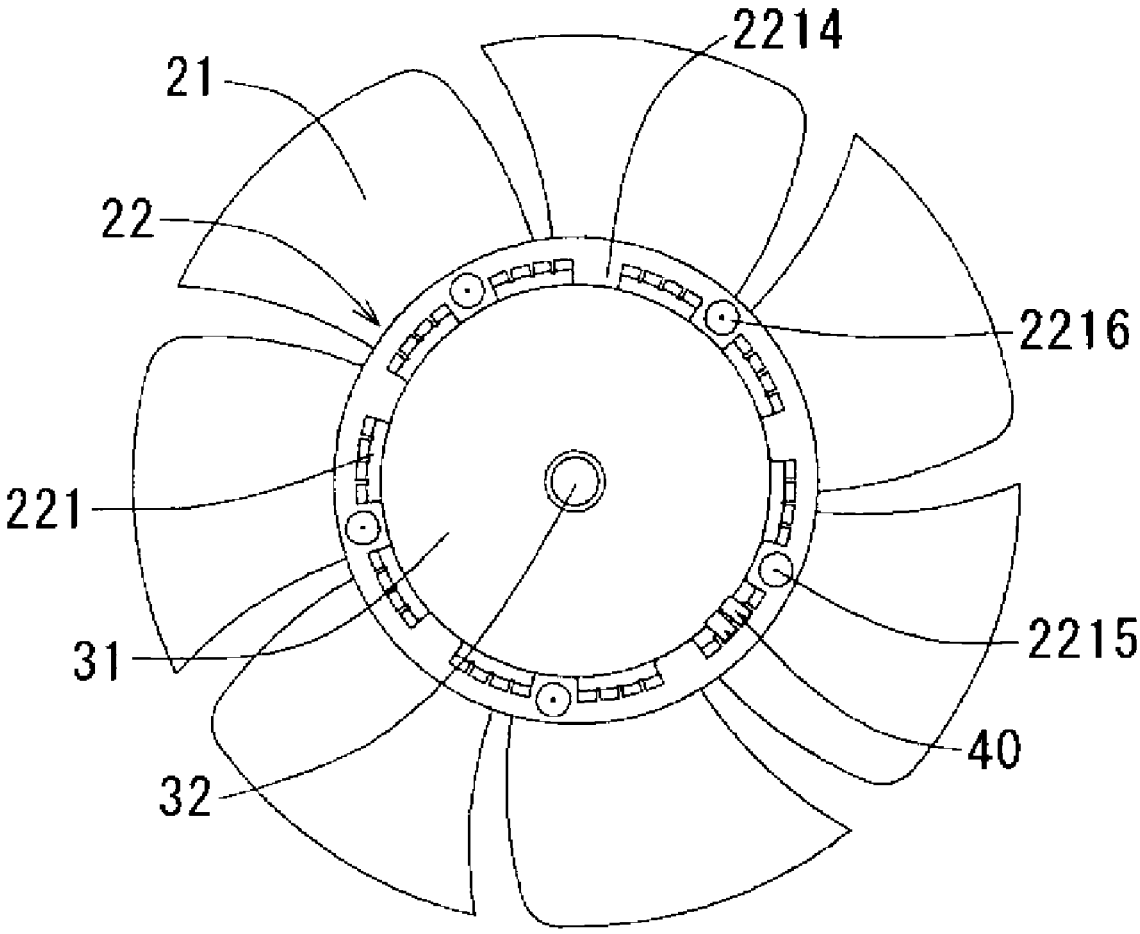
FIG. 5 is a plan view of a rotor according to the preferred embodiment of the present invention.

FIG. 1 shows a cross section of a fan according to a preferred embodiment of the present invention. FIG. 2 shows a balance weight holding portion of the fan of FIG. 1. FIG. 3 shows the balance weight holding portion with a balance clip. FIG. 4 is a perspective view of a hub of the fan of FIG. 1. In FIG. 4, blades of an impeller of the fan are omitted. FIG. 5 is a plan view of a rotor of the fan of FIG. 1.

Referring to FIG. 1, the fan 1 includes an impeller 2 coupled to a substantially cylindrical rotor holder 31 with a lid. The rotor holder 31 is driven and rotated when an electric current is supplied from an external device. The impeller 2 has a plurality of blades 21 centered on an axis serving as a rotation axis of the fan 1. The rotor holder 31 has a shaft 32. One end of the shaft 32 is fastened and secured to the rotor holder 31 at the center of the lid of the rotor holder 31.

The rotor holder 31 is supported on a base 12 via the shaft 32 in a rotatable manner. A substantially cylindrical bearing housing 1021 is disposed on a central portion of the base 12. Ball bearings 341 and 342 are fixed to two step portions provided on the inner peripheral surface of the bearing housing 1021. Each of the ball bearings 341 and 342 includes three members, i.e., an outer race, an inner race, and balls. The balls are arranged between the outer race and the inner race, and the balls roll there while being in contact with the outer race and the inner race.

In this configuration, the inner race freely rotates relative to the outer race. The shaft 32 is inserted into a space defined by the inner peripheral surfaces of the inner races of the ball bearings 341 and 342. In this manner, the shaft 32 and the ball bearings 341 and 342 form together a bearing portion. A coil spring 390 for applying a predetermined preload to the ball bearings 341 and 342 is disposed at a gap between the above-mentioned step portion and the ball bearing 342 in the axial direction.

An annular groove (not shown) centered on the rotation axis is formed in a portion close to a lower end or at the lower end of the shaft 32. A wire ring 391 is fitted into that annular groove to retain the shaft 32 within the ball bearing 342. The structure of the bearing portion is not limited to the above. For example, a sliding bearing such as an oil impregnated bearing may be used.

A stator 3 is supported at an outer periphery of the bearing housing 1021. The stator 3 mainly includes a stator core stack 35, coil windings 37, and an insulator 36. The stator core stack 35 is formed by stacking a plurality of thin plates. The stator core stack 35 has a plurality of magnetic pole teeth projecting radially outward from the rotation axis. The insulator 36 made of insulating material surrounds the stator core stack 35 so as to electrically insulate the upper and lower ends and the individual magnetic pole teeth of the stator core stack 35 from each other. The coil windings 37 are arranged around each of the magnetic pole teeth via the insulator 36.

At a lower end portion of the stator 3 is attached the circuit board 38. The circuit board 38 includes a circuit that controls the rotation of the impeller 2. In the circuit board 38, at least one electronic component (not shown) is mounted on a printed board. A leading end of the coil winding 37 is electrically connected to the electronic component of the circuit board 38, thereby constituting a rotation control circuit. The circuit board 38 is secured at a position below the insulator 36. When the coil winding 37 is energized with an electric current supplied from an external power source through the electronic component including an IC (integrated circuit) and/or a Hall element, a magnetic field is generated on the stator core stack 35.

The impeller 2 includes a substantially cylindrical hub 22 about the rotation axis and a plurality of blades 21 radially arranged around the external surface of the hub 22. The blades 21 are turned about the rotation axis so as to produce an airflow. A rotor holder 31 is provided on the inner circumferential surface of the hub 22, and a rotor magnet 33 is attached to the inner surface of the rotor holder 31. The rotor holder 31 reduces leakage flux toward the outside of the fan 1. The rotor magnet 33 is magnetized such that a plurality of magnetic poles are alternately arranged on the inner peripheral surface thereof in the circumferential direction. The shaft 32 fastened at the center of the rotor holder 31 is inserted through the ball bearings 341 and 342, so that the rotor magnet 33 and the stator core stack 35 are arranged to face each other in a radial direction perpendicular to or substantially perpendicular to the rotation axis. When an electric current flows through the coil windings 37, the magnetic field is generated from the stator core stack 35 and interacts with a magnetic field produced by the rotor magnet 33 so as to generate rotary torque about the rotation axis. The rotary torque is applied to the impeller 2, thereby rotating the impeller 2 about the rotation axis. The Hall element (not shown) detects changes in the magnetic flux of the rotor magnet 33 during rotation, based on which a drive IC controls the rotation, so that the impeller 2 can be rotated stably. When the impeller 2 is driven and rotated, the blades 21 push out air toward one end side in the axial directions and an airflow is thus produced in the axial direction.

The base 12 is disposed to axially face the circuit board 38. The base 12 is formed into a generally disk-like shape having almost the same diameter as the outer diameter of the circuit board 38. The base 12 is coupled to a housing 10 with a plurality of ribs 13. In this preferred embodiment, four ribs 13 are provided. The ribs 13 extend radially outward from the base 12 and are coupled to the housing 10 at their distal ends (i.e., their radially outer ends). Please note that the number of the ribs 13 is not limited to four. For example, three or five ribs 13 may be provided. In this preferred embodiment, the four ribs 13 are regularly arranged in the circumferential direction.

The housing 10 is formed so as to enclose the impeller 2 from the outer side in the radial direction. An air channel 11 is formed at the inner side of the housing 10. The air channel 11 serves as an air passage of the airflow generated by the rotation of the blades 21. The housing 10 is in the form of a substantially rectangular frame whose outer periphery at both the axially upper and lower ends is substantially square shape, when viewed in the axial direction. At corners of the axially upper and lower ends of the housing 10, flanges 14 are arranged to protrude outward in the radial direction. A mounting hole **14*a* is formed in each of the flanges 14. The mounting hole 14*a* is used for insertion of an attachment such as a screw in mounting the fan 1** to a device.

An annular portion 221 as a weight adjustment portion is provided to protrude radially inward at an upper end portion of the hub 22. FIGS. 2 and 3 show the annular portion 221 in an enlarged view. A balance clip 40 is attached to the annular portion 221, as shown in FIG. 2.

The rotor of the fan 1 of this preferred embodiment mainly includes the blades 21, the hub 22, the rotor holder 31, the rotor magnet 33, and the shaft 32. The blades 21 and the hub 22 are formed integrally by injection molding of a resin. The rotor holder 31 is formed by press work. These components may rotate in an unbalanced manner at least with respect to the rotation axis.

The unbalanced rotation in this application means a state in which the rotation axis of the rotor is not coincident with the center of gravity of the rotor. When the rotor is rotated with its rotation axis not coinciding with the center of gravity of the rotor, the center of gravity thereof rotates around the rotation axis. As the distance increases between the center of gravity and the rotation axis, the unbalance amount becomes larger. The unbalance amount is expressed as a product of the amount of weight unbalance (weight: g) and a distance between the rotation axis and a position causing unbalanced rotation (distance from the rotation axis in the radial direction: cm); therefore, the unbalance amount is indicated mainly in a unit of g·cm. For example, assuming that the rotor has a unbalance amount of 1.0 g·cm, it is possible to reduce the unbalance amount to 0 g·cm theoretically by placing a balance weight of 1.0 g at a position of 1.0 cm away from the rotation axis in the radial direction such that the balance weight is located on the opposite side of the rotation axis to the position causing unbalance. The unbalance amount is typically corrected such that a balance weight is added at a position axisymmetric to the position which causes unbalanced rotation so as to compensate for unbalance of rotation.

Rotors cannot always be manufactured in stable dimensions with reliable precision according to changes in processing conditions and environment in mass-production lines. Unbalance amounts, therefore, vary depending on individual rotors. It is physically impossible to manufacture components with the unbalance amount of 0 g·cm in mass-production.

Various efforts are, however, made to reduce the unbalance amount as much as possible in processing rotors. When two or more rotors rotating in an unbalance manner are combined into one, those rotors are arranged to minimize total unbalance of rotation of a resultant rotor. The unbalance of rotation, however, may not be improved even through the rotors are combined such that their unbalance amounts are counterbalanced, since there is a possibility that the rotors to be combined are not precisely coaxial. Consequently, it is not possible to bring the unbalance amount to 0 g·cm in a case of forming a rotor by combining processed components used in mass production.

In this preferred embodiment, the unbalance of rotation is corrected by attaching the balance clip 40 to the annular portion 221 as the weight adjusting portion, as described above. In particular, more than one balance clips 40 are attached for correcting unbalance of rotation of a rotor with which the unbalance amount is large. The balance clip 40 is made of an anti-corrosive metallic material such as stainless steel. Since the metallic material has a larger specific gravity than resin and the like, unbalance of rotation can be corrected with small volume. It should be noted that the material of the balance clip 40 is not limited to the metallic material including stainless steel, and may be altered appropriately.

The balance clip 40 of this preferred embodiment is formed into an approximately U-shape, as shown in FIG. 2. Since the balance clip 40 is made of stainless steel (a resilient material), restoring force occurs in directions opposite to the directions in which both tips of the U-shaped balance clip 40 are moved when a load to separate them is applied. The balance clip 40 is fixed to the annular portion 221 utilizing the restoring force by a method to be described later. The balance clips 40 are machined through a progressive press forming. The press forming method is so high in productivity that the balance clips 40 can be manufactured at low cost.

In this preferred embodiment, the blades 21, the hub 22, the rotor holder 31, the rotor magnet 33, and the shaft 32 construct an impeller assembly, which is a rotor. The impeller assembly is loaded onto a balance measuring device (a measuring device for measuring the unbalance amount with respect to the rotation axis of a rotor) for measurement of the unbalance amount of the impeller assembly. The balance measuring device indicates a direction and a magnitude of unbalance of rotation. More specifically, the balance measuring device indicates, as the direction of the unbalance of rotation, an angle of the position about the rotation axis when a predetermined point is assumed to be 0 degree. The magnitude of the unbalance is indicated as the aforementioned unbalance amount in unit of g·cm. Based on the measurement result, at least one balance clip 40 is attached to the annular portion 221. Then, the impeller assembly is again loaded onto the balance measuring device. A specified value is preliminarily set for the unbalance amount of the impeller assembly, and the above-described steps are repeatedly performed on the impeller assembly until the measured unbalance amount comes below the specified value. If the impeller assembly has a unbalance amount smaller than the specified value in the state where the balance clip 40 is not attached, the balance clip 40 need not be attached.

The U-shaped balance clip 40 is fitted onto the annular portion 221 outward in the radial direction. Restoring force is generated in the directions opposite to the separating directions of the tips of the opening of the U-shape when they are pulled apart from each other. The upper and lower surfaces of the annular portion 221 are pinched with the balance clip 40 by this restoring force.

The balance clip 40 is attached to the annular portion 221 as described above, so that unbalance of rotation of the rotor is corrected.

The rotor holder 31 is press-fitted into the hub 22 to be secured on the inner surface of the hub 22. With the rotor holder 31 press-fitted in the hub 22, a gap 50 is formed between the upper surface of the rotor holder 31 and the lower surface of the annular portion 221, as shown in FIG. 3. The gap 50 thus formed provides the space into which the tip of the U-shaped balance clip 40 is inserted. If the size of the gap 50 is taken too large, the hub 22 becomes high in the axial direction. As a result, the entire fan 1 becomes high. It is only necessary, therefore, for the gap 50 to have a size that only allows the tip of the U-shaped balance clip 40 to be inserted therein. Specifically, the gap 50 preferably has a size not less than about 0.4 mm and not more than about 1.0 mm.

In this preferred embodiment, the steel sheet of about 0.2 mm in thickness is used for forming the balance clip 40. The balance clip 40 preferably has a thickness in the order of about 0.2 mm in terms of mass per volume and strength of the balance clip 40. The gap 50, therefore, needs to have a size not less than about 0.2 mm in order to physically allow the balance clip 40 to be fitted onto the annular portion 221. In view of work ability, the gap 50 preferably has a margin in size for fitting the balance clip 40 onto the annular portion 221. The size of the gap 50 will be described later.

A portion of the upper surface of the lid of the rotor holder 31, which axially faces the annular portion 221, is arranged lower in axial height than another portion thereof. The axial height of the impeller assembly is dependent on the dimensions of the stator 3 to be housed within the rotor holder 31 on the inner surface side. Namely, the rotor holder 31 is designed to have a minimum possible size that allows the stator 3 to be housed therein. The axial height of the rotor holder 31 needs to be set such that the rotor holder 31 does not contact the coil windings 37 at a portion where the rotor holder 31 is located axially above the coil windings 37. However, the rotor holder 37 may have an axial height lower than that of the coil windings 37 in the radially outside of the rotor holder 37 because the rotor holder 37 does not come into contact the coil windings 37. And besides, with the height thus made lower, the annular portion 221 does not protrude excessively from the upper surface of the impeller assembly axially upward.

Referring to FIG. 1, a portion 311 of the upper surface of the rotor holder 31, which is located radially inside the annular portion 221, slants upward as it moves radially inward. This portion 311 is hereinafter referred to as an inclined surface 311. This inclined surface 311 allows the tips of the balance clip 40 into a gap 50 (see FIG. 3) between the annular portion 221 and the rotor holder 31 to be inserted almost parallel to the inclined surface 311. The insertion of the balance clip 40 is completed in a state where it is parallel to the radial direction. That is, where the gap 50 is the same in size as the steel sheet forming the balance clip 40, it is physically impossible to insert the balance clip 40 therein as the balance clip 40 is inserted in a state parallel to the inclination angle of the inclined surface 311. It is, therefore, necessary to provide a gap in a size of about 0.4 mm or more, in order to have the balance clip 40 of about 0.2 mm in thickness inserted therein. Where the size of the gap 50 is larger than about 1.0 mm, the impeller assembly becomes high in the axial direction, which is less advantageous as compared with the case where the balance clip 40 is attached in the axial direction.

Figure 6:
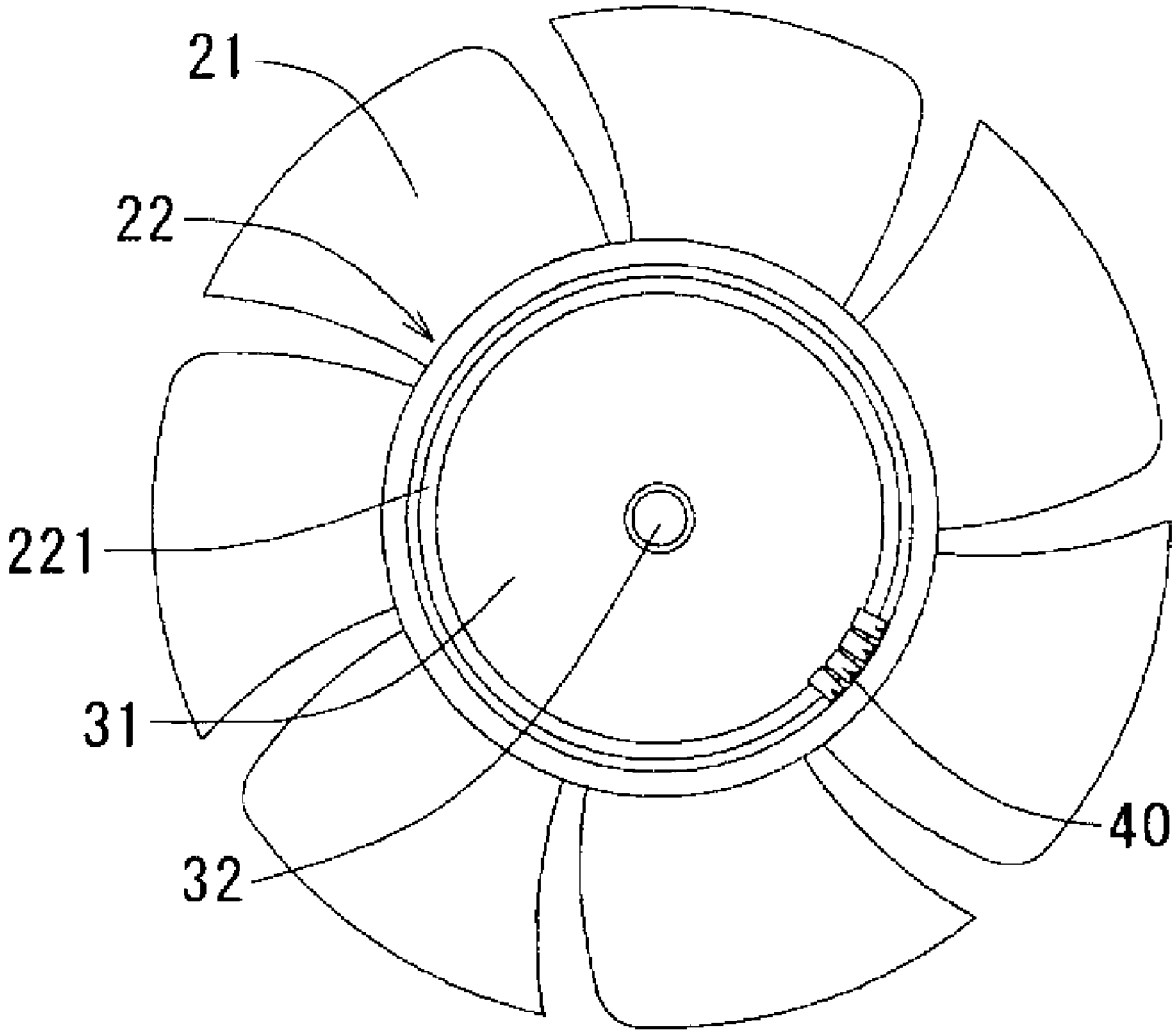
FIG. 6 is a plan view of a rotor according to a modification of the preferred embodiment of the present invention.

In the fan 1 used for cooling the interior of the housing of an electronic device, the mass of the impeller assembly is smaller in comparison with large fans. Hence, the fan 1 has a smaller unbalance amount than those of large fans, and thus requires a smaller amount of correction of unbalance of rotation. The diameter of the impeller assembly is not more than 150 mm in most of the fan 1; therefore, the balance clip 40 needs to be attached at a position radially inward of the diameter of 150 mm. As shown in FIGS. 1, 5, and 6, the blades 21 are coupled to the exterior of the hub 22. In this preferred embodiment, the balance clip 40 is attached to the hub 22 (to be exact, to the annular portion 221). In the impeller assembly of 150 mm in diameter, the hub 22 is approximately 60 mm in diameter. Consider a case in which the unbalance amount is to be corrected to 0.2 g·cm or less in the impeller assembly having an uncorrected unbalance amount of 0.3 g·cm. A procedure for correcting unbalance of rotation is described hereinafter.

In a case where the balance clip 40 is attached to the hub 22 at a position 50 mm in diameter, the mass of the balance clip 40 necessary for correcting unbalance of rotation is obtained by dividing the unbalance amount to be corrected by the radius. First, the unbalance amount to be corrected is calculated by subtracting a target unbalance amount from the uncorrected unbalance amount, i.e., 0.3 g·cm−0.2 g·cm. Next, the mass of the balance clip 40 required for the correction of the unbalance amount is calculated by dividing the unbalance amount to be corrected by a distance from the rotation axis to the position at which the balance clip 40 is to be attached, i.e., 0.1 g·cm/25 mm=0.04 g. The balance clip 40 is formed in the order of about 0.025 g in mass per piece in consideration of fine adjustment of unbalance of rotation. Thus, in the case described above, two pieces of the balance clip 40 are used for correcting unbalance of rotation.

When it is already known that the unbalance amount to be corrected is large, either of a balance clip 40 made of a material with a large specific gravity or a balance clip 40 large in size is used. The method of this preferred embodiment is applicable not only to the correction for the impeller assembly having the above dimensions but also for impeller assemblies having other dimensions.

The balance clip 40 used in this preferred embodiment is about 0.025 g in mass as described above; therefore, if a stainless steel of 0.2 mm in thickness is used as a material, the balance clip 40 is to have an approximate U-shape of about 0.3 mm in the radial direction and about 2.0 mm in the axial direction, in the state where the balance clip 40 is attached to the annular portion 221. In the case where the balance clip 40 is fitted in the axial direction with respect to the impeller, it is necessary for the structure for attachment of the balance clip to have a size of 3.0 mm or more in the axial direction. In the case where the balance clip 40 is fitted onto the annular portion 221 outwardly in the radial direction and the gap 50 is sized in 1.0 mm or more, it is necessary for the structure for attachment of the balance clip to have a size of at least about 3.0 mm in the axial direction. Hence, it is possible to make the impeller assembly shorter in the axial direction by sizing the gap 50 in 1.0 mm or less.

The gap 50 between the annular portion 221 and the rotor holder 31 in the axial direction is used as a space into which the balance clip 40 is inserted. It is thus necessary that the gap 50 be maintained at a uniform size in the state where the impeller 2 and the rotor holder 31 are combined. For this purpose, a plurality of seats 2213 are arranged at regular circumferential intervals beneath the annular portion 221, as shown in FIGS. 1 and 4. Without the seats 2213, dimensional control is required to ensure the gap 50 for press-fitting the rotor holder 31 into the hub 22. For example, dimensional accuracy of the press-fitting needs to be increased by using a servomotor. However, since the seats 2213 are provided in the present preferred embodiment, the rotor holder 31 may be press-fitted into the hub 22 until it comes into contact with the seats 2213. The gap 50 is thus formed in the same size as that of the seat 2213 in the axial direction. Therefore, dimensional accuracy of press-fitting is not required with a press-fitting machine to be used in press-fitting the rotor holder 31 into the impeller 2.

The balance clip 40 cannot be fitted at the position where the seat 2213 is formed in the annular portion 221. Thus, position-indicating projections 2214 are formed on the upper surface of the annular portion 221 at the positions where the seats 2213 are formed, as shown in FIGS. 4 and 5. The position-indicating projection 2214 enables a worker to confirm the positions where the seats 2213 are formed from above the rotor when he or she fits the balance clip 40 onto the annular portion 221.

The blades 21, the hub 22 and the annular portion 221 are integral with one another through injection molding of a resin. The resin injection molding is carried out with two molding dies, i.e. an upper molding die and a lower molding die. The upper molding die and the lower molding die are brought into contact with each other to form a closed space therebetween. A molten synthetic resin is injected into the closed space, the upper and lower dies are opened and separated from each other, the resin that has been solidified in the shape of the closed space is ejected and taken out, and thus a molded product is obtained. In this preferred embodiment, the closed space is formed in the shape of the impeller 2, so that the impeller 2 is molded therein.

It is necessary to provide a gate for injecting resin into molding dies to carry out resin injection molding. The gate is formed at the boundary portion between the inside and the outside of the molding die, and upon opening of the molding dies, the resin inside the molding die and the resin outside the molding die are cut in the gate. In the resin injection molding, therefore, a gate cutting mark 2215 is left on the side of the molded product. Generally, the gate cutting mark 2215 is disposed in a portion where high dimensional accuracy is not required. If the gate cutting mark 2215 is formed on the surface of the blade 21, for example, a turbulent flow is likely to occur in the air flow because of the gate cutting mark 2215 on the surface of the blade 21 during the rotation of the impeller 2, which will become a cause of noise. If the gate cutting mark 2215 is formed in a portion where high dimensional accuracy is required, such as for positioning, a dimensional distortion may be caused by the gate cutting mark 2215 in the positioning, which may bring about a structural problem. In this preferred embodiment, therefore, the gate cutting mark 2215 is formed on five out of the ten position-indicating projected portions 2214, as shown in FIGS. 4 and 5. In particular, since the gate cutting mark 2215 tends to be formed in a projecting manner, it is disposed in a recessed portion 2216, as shown in FIG. 4, so that the gate cutting mark 2215 does not project from the upper surface of the annular portion 221.

The annular portion 221 is formed such that the upper end surface thereof is positioned lower than the upper end surface of the hub 22 so as not to let the balance clip 40 project from the upper end surface of the hub 22 in the state where the balance clip 40 is attached to the annular portion 221. With this structure, when a component, which does not belong to the fan 1, is disposed on the upper end surface side of the hub 22 of the fan 1, the balance clip 40 can be prevented from touching the component disposed outside the fan 1, should external impact force be accidentally applied to the fan 1 and the hub 22 bounce out to touch the component. Further, since the balance clip 40 is fitted outwardly in the radial direction, the balance clip 40 will not fly out to the outside in the radial direction even when centrifugal force acts on the balance clip 40 with the rotation of the impeller 2.

Referring to FIG. 3, an increased-thickness portion 2211 which axially projects from another portion of the upper surface of the annular portion 221 is formed at a radially inner end of the annular portion 221. A wall-like portion between the increased-thickness portion 2211 and an adjacent portion which is thinner than the increased-thickness portion stops the balance clip 40 fitted to the annular portion 221. With this structure, the balance clip 40 can be fixed more firmly. Particularly in this preferred embodiment, a retaining portion 41 is formed at a tip of the balance clip 40, so that the balance clip 40 can be fixed even more firmly with the retaining portion 41 stopped.

Figure 7:
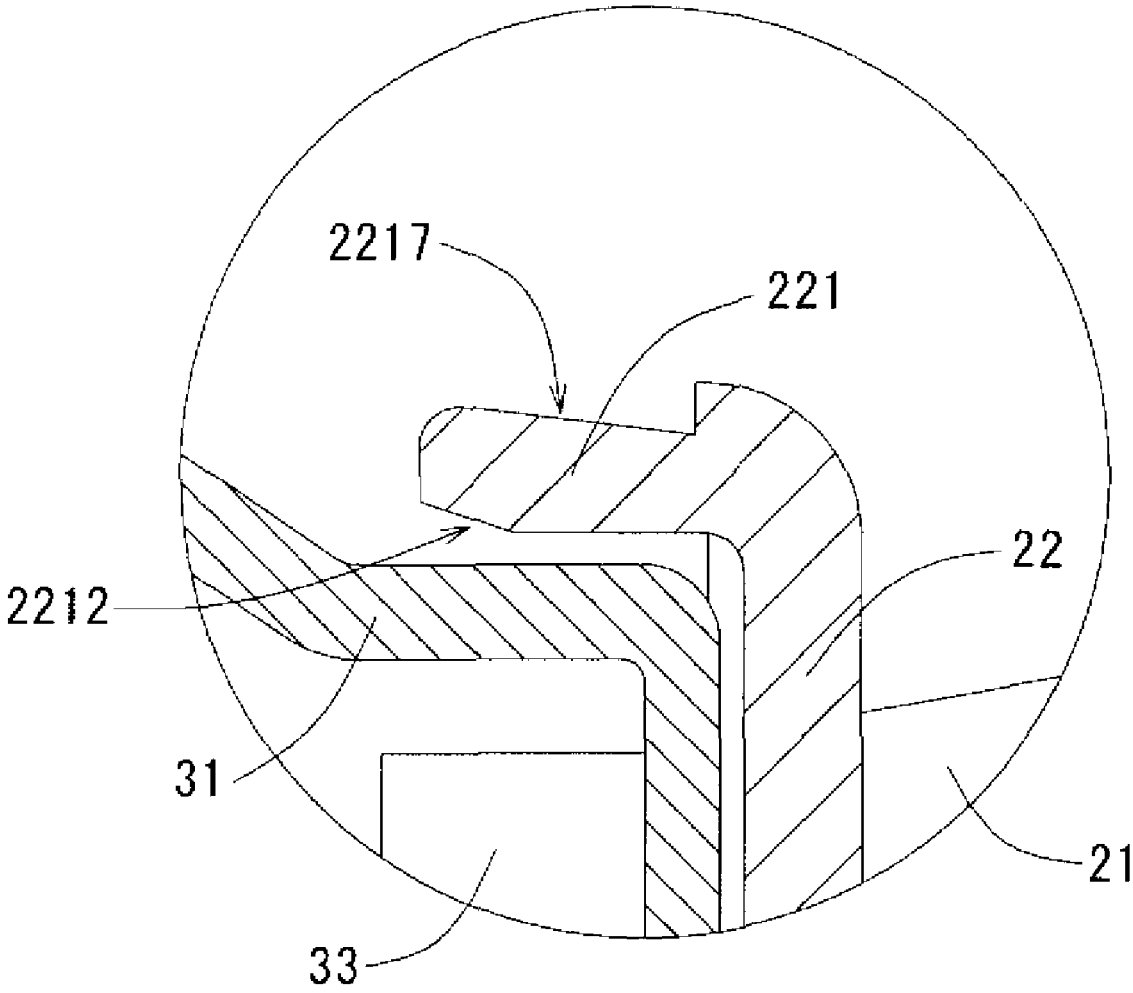
FIG. 7 shows another exemplary weight adjusting portion according to the preferred embodiment of the present invention.

The cross-sectional shape of the annular portion 221 is not limited to above-described structure. For examples a tapered portion 2217 may be formed such that an axial thickness of the annular portion 221 is gradually reduced radially outward, as shown in FIG. 7. In the shape illustrated in FIG. 7, the retaining portion formed at the tip of the balance clip 40 is retained at the tapered portion 2217, thereby fixing the balance clip 40 to the circular portion.

Figure 8:
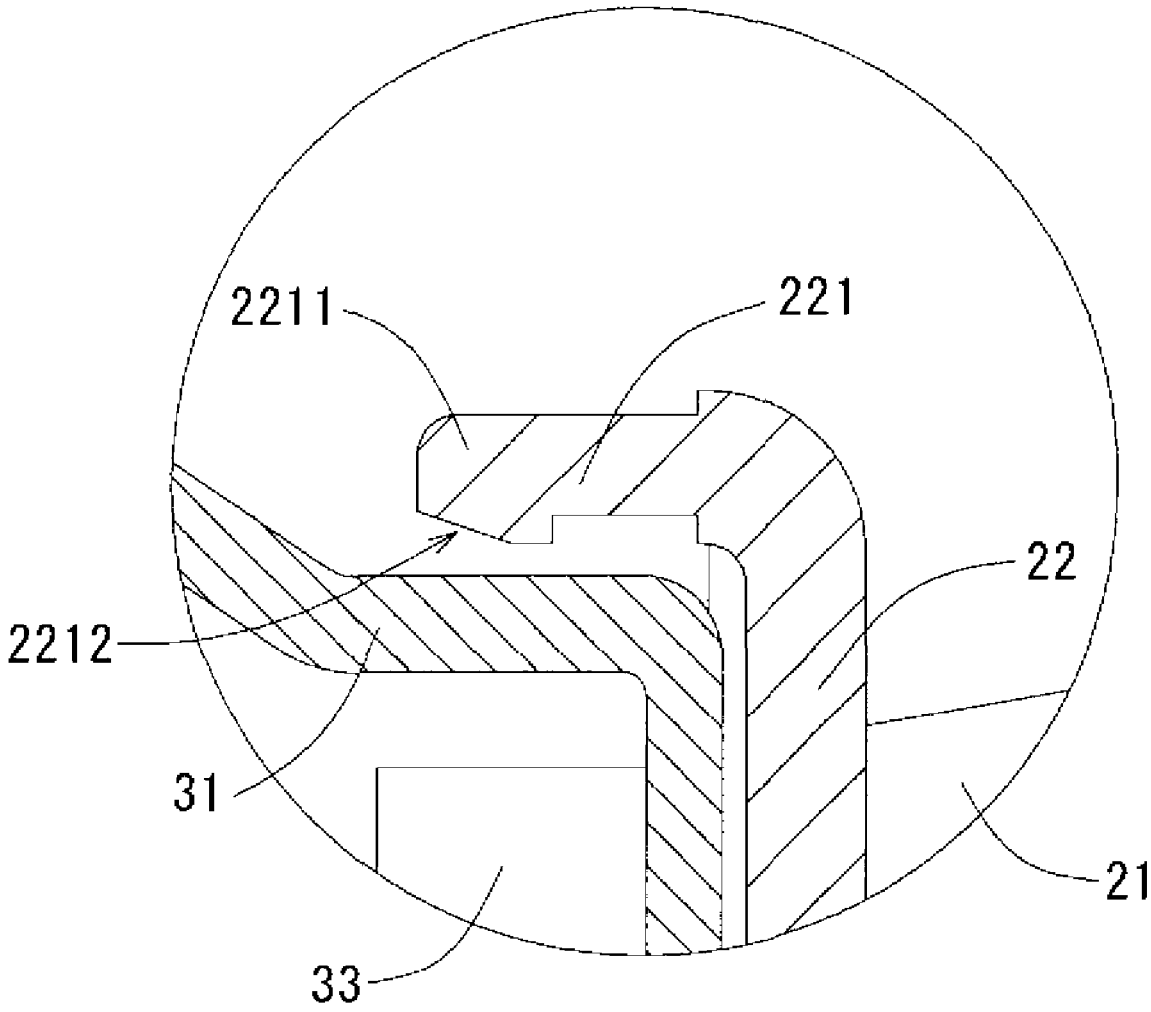
FIG. 8 shows still another exemplary weight adjusting portion according to the preferred embodiment of the present invention.

Alternatively, the increased-thickness portion 2211 may be arranged on the lower surface of the annular portion 221, i.e., the surface which axially faces the rotor holder 31, as shown in FIG. 8. In this case, the balance clip 40 needs to be fitted with the retaining portion side down. A similar effect can also be obtained with this structure.

Figure 9:
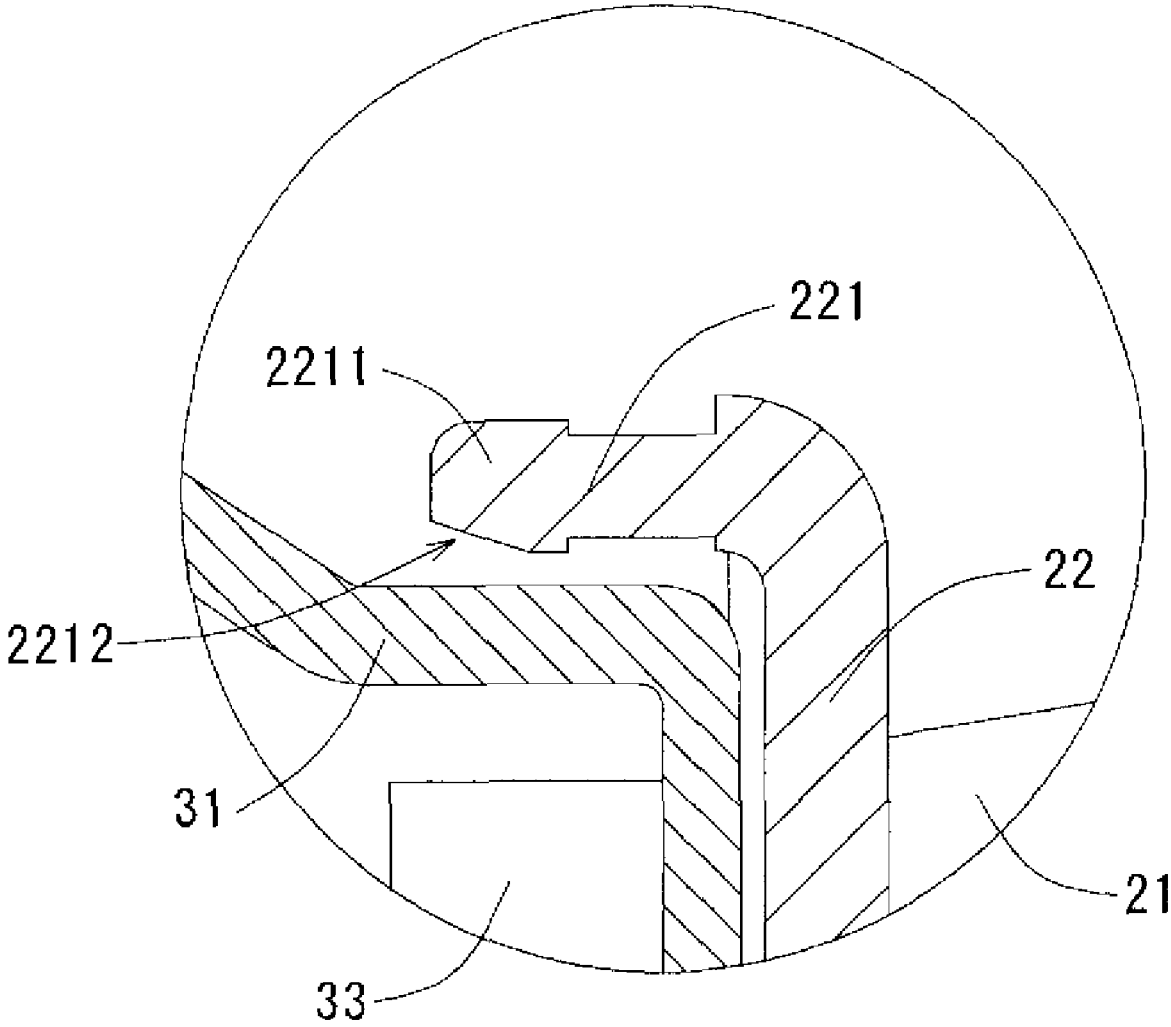
FIG. 9 shows further another exemplary weight adjusting portion according to the preferred embodiment of the present invention.

The projections may be so provided on both of the upper and lower surface side of the annular portion 221 such that the wall-like portion between the projection and the adjacent non-projecting portion is formed on each of the upper and lower surfaces, as shown in FIG. 9. In this case, the balance clip 40 needs to be provided with the retaining portions on both of the arms. In this modification, the balance clip 40 can be fixed to the annular portion 221 even more firmly. The cross-sectional shape of the annular portion 221 can suitably be altered to any shape, so long as it allows the balance clip 40 to be fixed thereto.

An inclined surface 221, which is at an angle to the radial direction and the axial direction, is formed between the radially inner end of the annular portion 221 and the lower surface thereof, as shown in FIG. 9. When the balance clip 40 is fitted onto the annular portion 221, the tips of the U-shaped balance clip 40 are drawn apart from each other along the inclined surface 2212, so that the fitting of the balance clip 40 can be performed smoothly as compared with the case where the inclined surface 2212 is not formed. Since the balance clip 40 is inserted obliquely with respect to the annular portion 221 in parallel to the inclined surface 311, the tapered surface 2212 enables smooth insertion of the balance clip 40.

A plurality of projected portions 2217 are arranged on the annular portion 221 around the rotation axis in the circumferential direction, as shown in FIG. 4. The space interval between each two adjacent projected portions 2217 in the circumferential direction is set to approximately the same size as the width of the balance clip 40. In this configuration, the balance clips 40 fitted onto the annular portion 221 are positionally regulated by the projected portions 2217 in the circumferential direction. That is, the balance clip 40 can be fitted onto the annular portion 221 without misalignment also in the circumferential direction. The projected portion 2217 may not be provided on the upper surface of the annular portion 221, as shown in FIG. 6.

Figure 10:
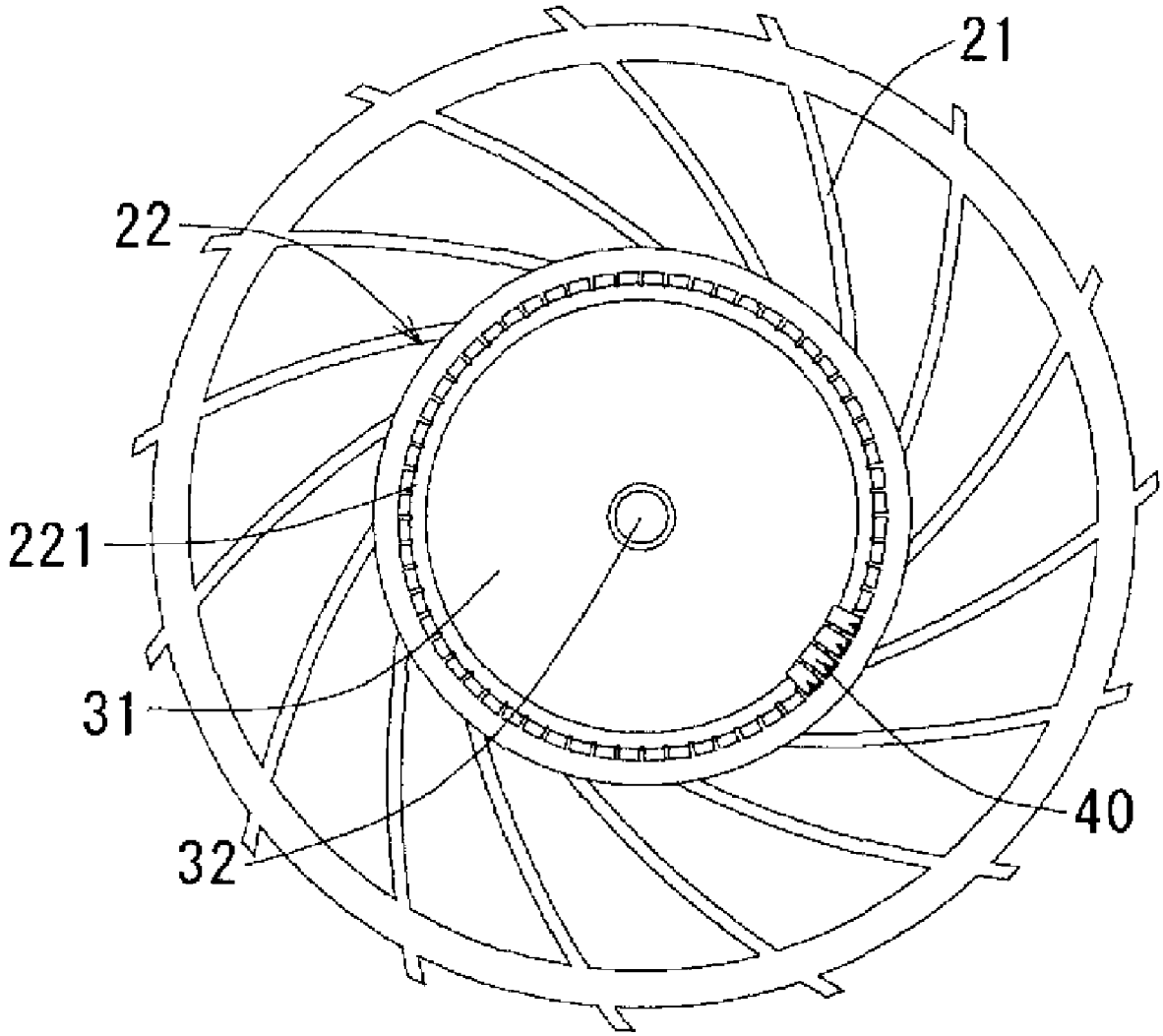
FIG. 10 is a plan view of another exemplary rotor according to the preferred embodiment of the present invention.

The description has been made on an axial flow fan (a fan in which air is taken and released in the axial direction) in the present embodiment. The present invention is, however, not limited thereto, and is applicable to a centrifugal fan (a fan in which air is taken in the axial direction and is released in the radial direction), as shown in FIG. 10. The shape of the hub is almost the same in the axial flow fan and the centrifugal fan. The axial flow fan and the centrifugal fan are different from each other mainly in the shape of the blade. The present invention has its feature in the shape of the hub, and therefore, is not limited by the shape of the blade of the axial flow fan.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A fan comprising:

a substantially cylindrical rotor holder with a lid rotatable about an axis;

a substantially annular rotor magnet secured on the inner peripheral surface of the rotor holder;

an armature arranged inside the rotor holder and facing the rotor magnet;

a substantially cylindrical hub extending along the axis and having a circumferential wall secured to an outer surface of the rotor holder; and a plurality of blades arranged on the hub and turnable by the torque to generate an airflow, wherein a weight adjusting portion is provided at one of axial ends of the hub to project inward in a radial direction substantially perpendicular to the axis, the weight adjusting portion and the hub covering at least an outer periphery of the lid of the rotor holder, and the weight adjusting portion is axially spaced away from the rotor holder.

2. The fan according to claim 1, wherein the weight adjusting portion is formed annularly.

3. The fan according to claim 1, wherein the weight adjusting portion has a recess radially outside a radially inner end of the weight adjusting portion.

4. The fan according to claim 1, wherein an axially farthermost point of the weight adjustment portion from the rotor holder is located between the rotor holder and an axially farthermost point of the hub from the rotor holder.

5. The fan according to claim 1, wherein the weight adjustment portion has an inclined surface which is at an angle to both the axis and the radial direction, the inclined surface being located to connect a radially inner end of the weight adjusting portion and a surface of the weight adjusting portion which faces the rotor holder.

6. The fan according to claim 1, wherein an axial distance between the weight adjusting portion and the rotor holder is not less than 0.4 mm and not more than 1.0 mm.

7. The fan according to claim 1, wherein a plurality of projected portions are circumferentially arranged on one of axial end surfaces of the weight adjustment portion which is farther from the rotor holder than the other axial end surface.

8. The fan according to claim 1, wherein a plurality of seats are circumferentially arranged on one of axial end surfaces of the weight adjustment portion which axially faces the rotor holder, and the seats are in axial contact with the rotor holder.

9. The fan according to claim 8, wherein position-indicating projections are provided on the other axial end surface of the weight adjustment portion at positions corresponding to positions of the seats on the one axial end surface, each position-indicating projection having a circumferential width equal to or larger than a circumferential width of each seat.

10. The fan according to claim 9, wherein an impeller including the hub and the blades is a single resin molded member, and a resin cut mark is formed on at least one of the position-indicating projections.

11. The fan according to claim 1, wherein a balance weight is attached to the weight adjusting portion.

12. The fan according to claim 11, wherein the balance weight is an approximately U-shaped balance clip, restoring force occurs when tips of the U-shaped balance clip are drawn apart from each other, and the balance clip is fitted onto the weight adjustment portion outwardly in the radial direction to pinch the weight adjustment portion from axially above and below.

13. The fan according to claim 12, wherein the balance clip is a pressed metal member.

14. The fan according to claim 13, wherein a retaining portion is formed on at least one of the tips of the balance clip, the retaining portion being retained at the weight adjustment portion when the balance clip is fitted onto the weight adjustment portion.

* * * * *